US006154981A

United States Patent [19]

Heikkila et al.

[11] Patent Number: 6,154,981

[45] Date of Patent: Dec. 5, 2000

[54] METHOD AND APPARATUS FOR IMPROVING THE DRYING CAPACITY OF A HOOD COVERING A YANKEE CYLINDER

[75] Inventors: Pertti Heikkila, Raisio; Nenad Milosavljevic, Turku, both of Finland

[73] Assignee: Valmet Corporation, Helsinki, Finland

[21] Appl. No.: 09/300,787

[22] Filed: Apr. 28, 1999

[30] Foreign Application Priority Data

Apr. 30, 1998 [FI] Finland ..... 980955

[51] Int. Cl.[7] ..... D06F 58/00

[52] U.S. Cl. ..... 34/451; 34/455; 34/114; 34/119; 34/122

[58] Field of Search ..... 34/445, 448, 451, 34/454, 455, 459, 114, 116, 117, 119, 122; 162/206, 290, 359.1, 360.2

[56] References Cited

U.S. PATENT DOCUMENTS

| | | | |
|---|---|---|---|
| Re. 28,459 | 7/1975 | Cole et al. . | |
| 3,576,078 | 4/1971 | Holt | 34/114 |
| 3,874,997 | 4/1975 | Kankaanpaa | 34/115 X |
| 4,268,974 | 5/1981 | Price | 34/114 X |
| 4,536,970 | 8/1985 | Eskelinen | 34/454 |
| 4,911,791 | 3/1990 | Mokvist | 162/290 |
| 5,385,644 | 1/1995 | Hannus et al. . | |
| 5,425,852 | 6/1995 | Joiner | 162/290 |
| 5,553,392 | 9/1996 | Hanaya | 34/116 X |

FOREIGN PATENT DOCUMENTS

| | | |
|---|---|---|
| 28 02 156 | 6/1979 | Germany . |
| WO 96/29467 | 9/1996 | WIPO . |

*Primary Examiner*—Stephen Gravini
*Attorney, Agent, or Firm*—Nixon & Vanderhye P.C.

[57] ABSTRACT

A method and an apparatus for improving the drying capacity of a hood covering a Yankee cylinder (10), when drying a web with a Yankee cylinder while conveying the web over the cylinder by blowing hot air jets against the web at the region of a first hood (12), said hot air jets having a temperature mainly <550° C. The drying capacity of the drying hood is increased by blowing hot air jets against the web conveyed over the cylinder at the region of a second hood, a so called hot air hood (14, 14', 14"), said hot air jets having a a temperature which is higher than the temperature of the hot air jets blown against the web at the first hood, or mainly >550° C.

24 Claims, 7 Drawing Sheets

METHOD AND APPARATUS FOR IMPROVING THE DRYING CAPACITY OF A HOOD COVERING A YANKEE CYLINDER

The present invention relates to a method and an apparatus defined by the introductory parts of the independent claims presented below for improving the drying capacity of a hood covering a Yankee cylinder.

In soft tissue production a restricting factor is often the drying of the web. Therefore an aim in new soft tissue machines and in machine replacements is particularly to increase the drying capacity provided by a Yankee hood. However, it is not anymore possible to increase the capacity by increasing the diameter of the Yankee hood, because the size of a conventional Yankee hood has in practice already now been increased to its maximum size.

An aim has also been to increase the drying capacity by increasing the temperature and the velocity of the drying air jets. In new Yankee hoods the temperature of the drying air jets have thus been raised even to a temperature of 500° C. to 550° C. A temperature increase even higher from this level would require the introduction of new materials which can withstand the new high temperatures in the hood structures, which would substantially increase the structural costs of the large-sized Yankee hoods. An increase of the temperature above the present level would also substantially increase the problems caused by temperature gradient stresses and thermal expansion, which already at present are relatively difficult to manage in the present large-sized hoods and hood sections.

Yankee hoods comprise generally two parts, i.e. they are divided into two separate sections, the so called wet end (WE) section and the dry end (DE) section. Profiling of the paper web is generally performed with a Yankee cylinder so that the dry end hood section of the Yankee hood is divided in the web cross direction into control sections which are individually controlled. Then the amount of hot air flowing through each control section can be controlled individully, for instance with dampers, and thus it is possible to influence the hot air jets flowing towards the web. However, this control decreases the average drying effect of the hood, because only those control sections where the dampers are completely open will operate with the maximum capacity. A disadvantage in present Yankee hoods can also be seen in that, due to practical reasons, large hood sections can not be divided into control sections as narrow as would be desirable regarding the profiling.

Earlier it has been proposed in the applicant's American patent publication U.S. Pat. No. 4,942,675 to control the profiling of the web by locating an IR dryer at the Yankee cylinder before the wet end section of the Yankee hood. However, a disadvantage of this solution can be seen in that the IR dryers require relatively much service, because they easily tend both to get broken and become dirty. Moreover, the efficiency of the IR dryers is low, and a large part of the power will be consumed as losses.

The object of the present invention is therefore to provide an improved method and apparatus for increasing the drying capacity of a hood covering a Yankee cylinder.

A particular object is to provide a method and an apparatus which in the drying at a Yankee cylinder enable the use of hot air jets which are hotter than the currently used hot air jets.

Then an object is also the provide a method and and apparatus which can improve the profiling of the web to be dried, without considerably lowering the drying capacity.

In order to attain the above mentioned purposes the method and the apparatus according to the invention are characterised by the characteristics presented in the characterising clauses of the independent claims presented below.

Thus a typical Yankee cylinder provided with the solution according to the invention is covered by at least one hot air hood which is smaller than the Yankee hood, in addition to the wet end and dry end Yankee hood sections. Hot air jets are blown from the Yankee hood sections towards the web passing over the Yankee cylinder, whereby the hot air jets generally have a temperature which is at most about 550° C. On the other hand, hotter air jets with a temperature >550° C. are blown from the hot air hood.

The hot air hood can be either a completely separate hood, which can be separately pulled out from its position over the Yankee cylinder, or combined with and/or supported on either hood section of the Yankee hood, so that when the Yankee hood sections are moved away from their positions over the Yankee cylinder the hot air hood at the same time will move farther away from the cylinder.

The size of the hot air hood extending across the web is substantially smaller than that of a conventional Yankee hood, so that the hot air hood only covers a sector of about 20° to 40° of the periphery of the Yankee cylinder, while a conventional two-part Yankee hood often covers the periphery over a sector of 180° or even more, typically a sector of 200° to 230°. When a hot air hood according to the invention is used it is possible to correspondingly reduce the coverage of the actual Yankee hood, when desired.

On the other hand the hot air hood according to the invention typically also has radial dimensions which are smaller than those of a conventional Yankee hood, and thus it occupies substantially less space around the Yankee cylinder. Thus the hot air hood can even be located in a very restricted space, for instance below the cylinder close to that position of the Yankee cylinder where the web is brought to the periphery of the cylinder with the aid of a press roll. The hot air hood can further be shaped so that its vertical cross section in the machine direction tapers in the downwards direction along the periphery, whereby the narrow part of the hot air hood can find place in a particularly narrow space between the Yankee cylinder and other equipment close to it. Thus the total coverage of the Yankee cylinder can be substantially increased compared to the prior situation.

Due to its small size the hot air hood is not affected by temperature gradient stress and thermal expansion in the same way as a large-sized Yankee hood. Due to the small size it is also conceivable that the hot air hood is made of more expensive materials which withstand high temperatures, an approach which is not generally applicable to a Yankee hood.

Advantageously a hot air hood according to the invention can also be used in the control of the web drying profile. Then the hot air hood is divided into several consecutive sections in the web cross direction, and in each section there is performed an individual control of the velocity of the hot air jets, and/or also of their temperature, if desired. Due to the small size of the hot air hood this hood can be divided even into relatively small control sections, compared to the corresponding sections in a Yankee hood, whereby the profile control will be more accurate than previously. A hot air hood can be designed so that when all its dampers are open it will blow for instance hot air jets at 700° C./150 m/s. When some of the dampers are controlled into a partly closed position the velocity of the hot air jets in the other sections will correspondingly increase slightly.

When the solution according to the invention is applied and when the drying profile is controlled with the aid of the hot air hood it is necessary to lower the total drying effect only in some small sections of the hot air hood, which does not have a comparable effect on the total drying as when the drying profile is controlled with the aid of the large sections of a Yankee hood. Then, when the invention is applied it may not be necessary at all to divide the large Yankee hood into control sections across the web, and to restrict the air volume flowing through the Yankee hood. When the solution according the invention is applied it is possible to continuously blow hot air at the full power from the Yankee hood. Thus the Yankee hood can continuously provide the full drying capacity.

The exhaust air from the region of the hot air hood, the air discharged from the space defined by the hot air hood and the Yankee hood, can be advantageously directed directly to the wet end section of the Yankee hood, where it is mixed with the recirculating air of the wet end section. Of course it is possible to arrange for the hot air hood a recirculating air system of its own, where the main part of the discharged moistened air is heated and recirculated, with the addition of compensating air, into the hot air hood to be blown against the web. However, the ducts of the recirculation system require space. On the other hand, a direct connection between the hot air hood and the Yankee hood can be made in a simple way, rather inexpensive, and saving space, without external air ducts. When the exhaust air of the hot air hood is directed into the Yankee hood it is correspondingly possible to continuously supply the hot air hood with fresh and relatively dry air, which has been heated in a burner or corresponding device to a suitable temperature, for instance 500° C. to 700° C., however typically to >550° C. Thus the air jets blown from the hot air hood will be relatively dry, which is advantageous.

A hot air hood according to the invention is thus advantageously arranged immediately before the hood section at the wet end of the Yankee hood, whereby the above mentioned recirculation of the exhaust air from the hot air hood to the wet end section of the Yankee hood is easily arranged. However, in addition or alternatively hot air hoods can be arranged also in other locations, when required, such as after the dry end hood section of the Yankee hood, or between the wet end hood section and the dry end hood section. When required, also a number of hot air hoods can be arranged over the Yankee cylinder.

The invention described above can be advantageously utilised particularly in existing soft tissue machines or in machine replacements. The solution according to the invention provides a higher production and a better quality, due to a better profile control.

At least the following advantages are obtained by using the hot air hood according to the invention:

it is possible to use very high blowing air temperatures, because the thermal expansion and the temperature gradient stresses can be more easily taken into account in a small hood than in a large Yankee hood;

a small hood can be designed to withstand very high blowing temperatures, despite the higher costs, whereas it may be impossible with a large hood;

the drying capacity of the hot air hood is higher than that of a conventional Yankee hood;

when a small hot air hood is used for profiling it is possible to use narrower control regions than previously for the profiling;

the structure of the large conventional hoods can be made simpler when the the profiling is carried out in a smaller hood;

a larger part of the Yankee cylinder periphery can be covered with hoods;

a hot air hood can also be arranged over already existing Yankee cylinders, without substantial changes in the already existing Yankee hood.

Below there is an example of how it is possible with the solution according to the invention to increase the drying capacity of a Yankee cylinder by using a hot air hood according to the invention in the drying, in addition to a conventional Yankee hood. Five different cases were examined, which used:

a conventional Yankee hood, having in different cases a coverage of either 2×90°, 2×100° or 2×110°, and having hot air jets of 500° C./120 m/s, and a hot air hood, having a coverage of 40°, and having hot air jets of either 700° C./120 m/s or 700° C./150 m/s.

| Case | Coverage of hot air hood | Coverage of Yankee hood | Total coverage |
|---|---|---|---|
| 1 | — | 2 × 110° | 220° |
| 2 | 40° | 2 × 90° | 220° |
| 3 | 40° | 2 × 90° | 220° |
| 4 | 40° | 2 × 100° | 240° |
| 5 | 40° | 2 × 110° | 260° |

| Case | Parameters of hot air hood | Parameters of Yankee hood | Relative drying capacity of Yankee hood (HT + WE + DE) |
|---|---|---|---|
| 1 | — | 500° C./120 m/s | 100 |
| 2 | 700° C./120 m/s | 500° C./120 m/s | 109 |
| 3 | 700° C./150 m/s | 500° C./120 m/s | 112 |
| 4 | 700° C./150 m/s | 500° C./120 m/s | 121 |
| 5 | 700° C./150 m/s | 500° C./120 m/s | 134 |

The above table shows that the hot air hood increases the drying capacity of the Yankee hood by about 9 to 34%. When it is estimated that the Yankee hood corresponds to about 60% of the evaporation in a soft tissue machine, we can estimate that at the hot air hood provides an increase of about 5 to 20% in the paper production.

The invention is described below with reference to the enclosed drawings, in which.

Figure 1:
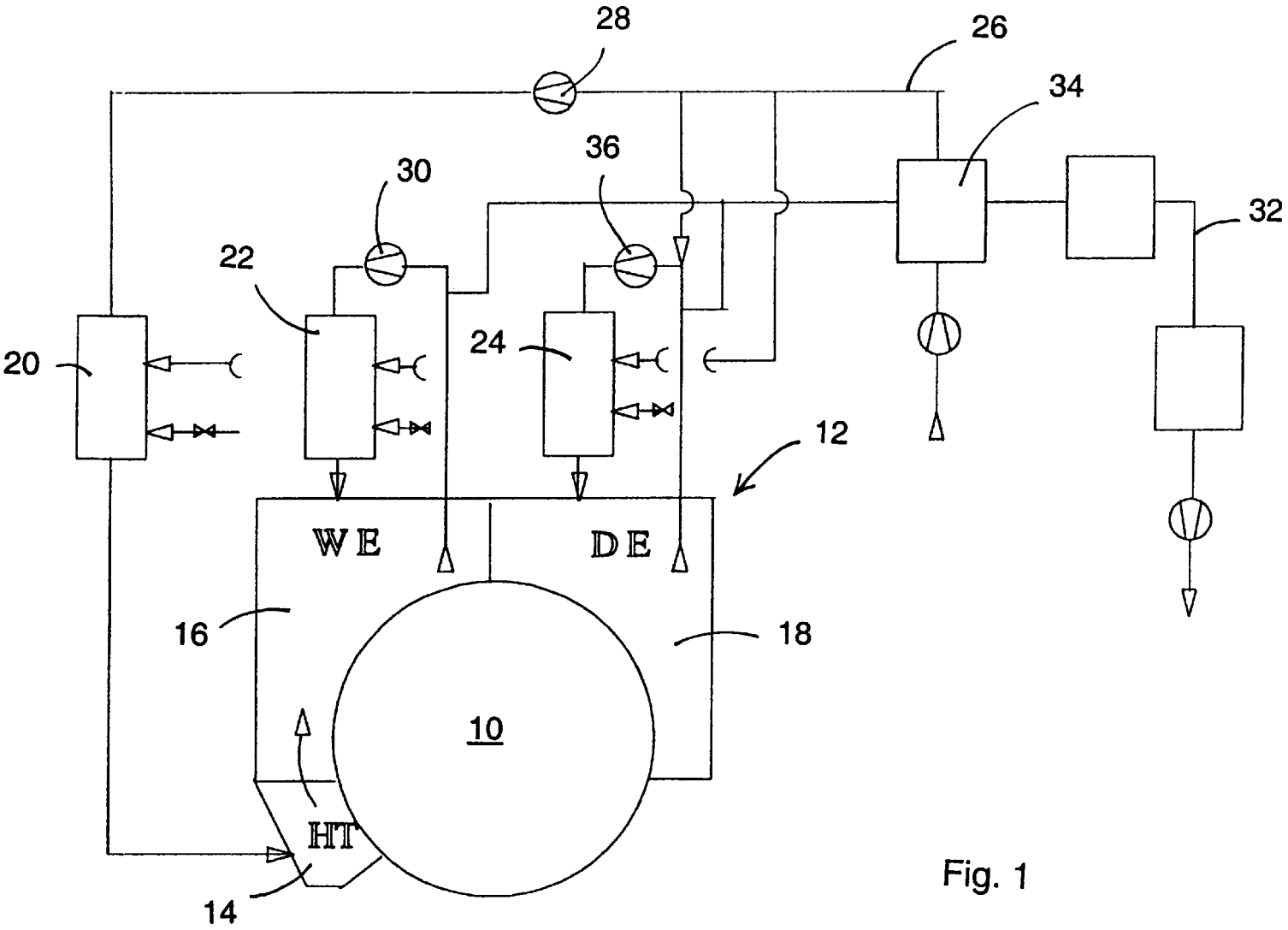
FIG. 1 shows schematically a Yankee cylinder with its air systems, and provided with a hot air hood according to the invention.

FIG. 1 shows a conventional Yankee cylinder 10 with a diameter of about 4500 mm, above which there are arranged a conventional two-part Yankee hood 12 extending across the web, and a hot air hood 14 according to the invention, which also extends across the web. The Yankee hood is divided into two sections 16, 18, the so called wet end hood section 16 and the dry end hood section 18, each of which cover more than 90° of the periphery of cylinder 10. The hot air hood 14 which covers only a small part, 20° to 40°, of the cylinder periphery, is arranged immediately in front of the wet end hood section 16. When desired, the hot air hood can cover up to 60° of the Yankee cylinder. Each hood 14, 16, 18 is provided with air heating equipment 20, 22, 24 comprising a burner. The combustion air for the burner is taken from the common compensating air duct 26.

Air is supplied by the fan 28 from the compensating air duct 26 into the air heating device 20, where the air is heated to a temperature typically >550° C. The air thus heated is supplied further to the hot air hood 14, from where the hot air is directed as hot air jets directly against the web passing in the range of the hot air hood along the Yankee cylinder 10 and in direct contact with the Yankee cylinder. The air which is blown towards the web, and which in this connection is cooled and slightly moistened, is returned to the hot air hood 14 and further directed from there to the wet end hood section 16 of the Yankee hood 12. In this hood section the partly cooled and moistened air is mixed with the circulating air of the section 16. The air returning from the hood section 16 is recirculated by the fan 30 through the hot air heater 22, in order to heat the air. A part of the returning air from section 16 is discharged along the exhaust air duct 32. The exhausted air passes then through the heat exchanger 34, where heat from the exhausted air is transferred to the air flowing in the compensating air duct 26. The wet end hood section 16 receives via the hot air hood 14 generally as much air as is required to compensate for the moist air discharched by the exhaust duct 32. This air volume typically corresponds to only about 10 to 20% of the air volume circulating in this hood section.

FIG. 1 shows for the sake of simplicity only that all air which is supplied to the hot air hood is directed to the wet end hood section. Of course also other air arrangements are conceivable, where the air is supplied to the hot air hood in a larger or smaller volume than that required by the wet end hood section, and that the extra air is directed elsewhere, or that the required additional air is supplied from elsewhere.

The compensating air duct 26 supplies air also to the air heating device 24 of the dry air hood section 18 of the Yankee hood 12, in which air heating device the air is heated. The heated air is further supplied to the dry end hood section 18, and from there further as hot air jets generally at a temperature <550° C. towards the web passing in the region of this section 18 and along the cylinder 10. The air returning from between the hood section 18 and the cylinder 10 is redirected to the hood section 18 and from there by a fan 36 further to the air heating device 24 to be reheated. However, a portion of the moist air is discharged to the exhaust duct 32. The compensating air duct 26 supplies compensating air to the dry end section 18, but only as much as is required to replace this exhausted moist air.

In the case shown in FIG. 1 two adjacent and generally independent recirculation air arrangements are arranged in the hood sections of the Yankee cylinder.

Figure 2:
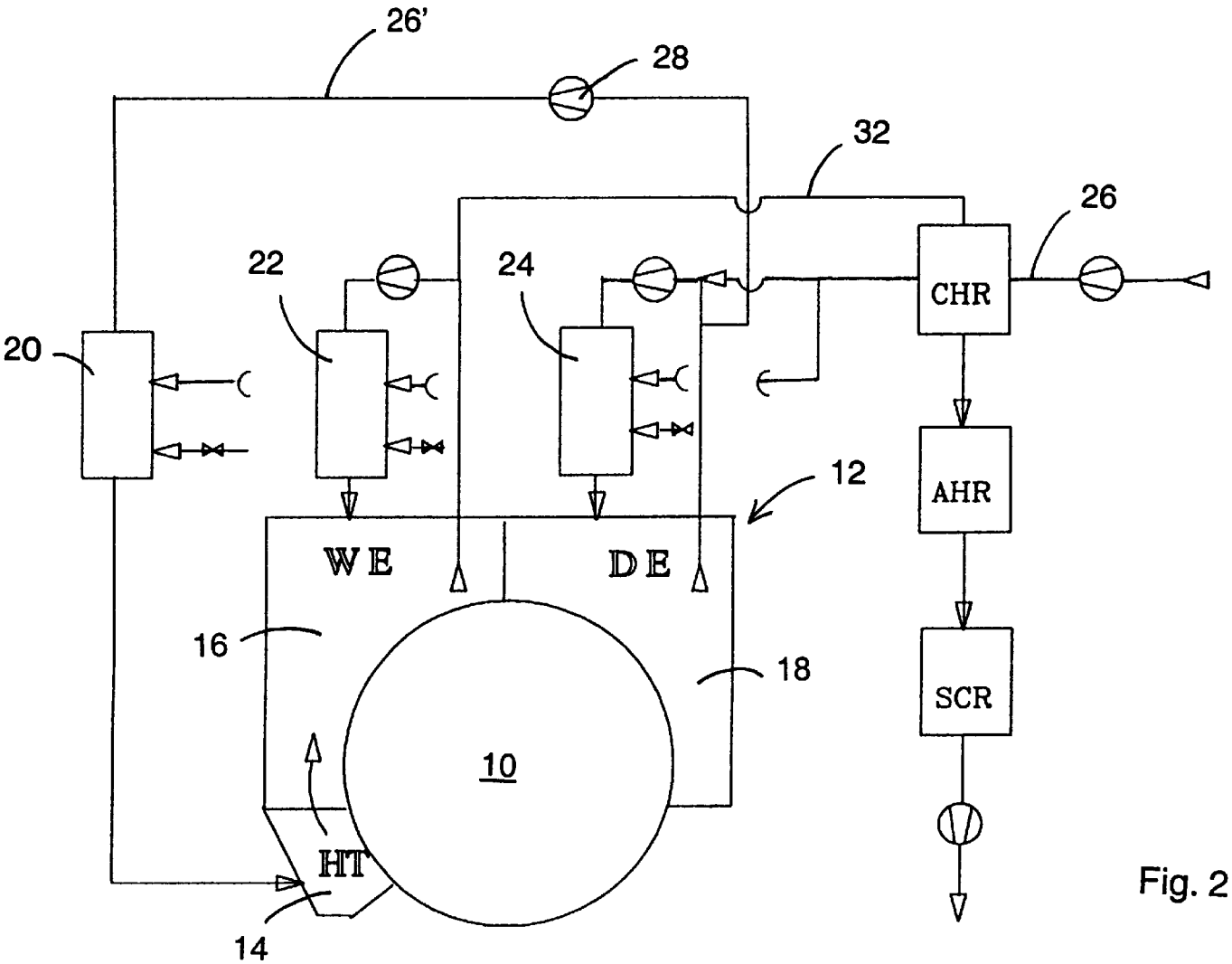
FIG. 2 shows another Yankee cylinder according to FIG. 1 with its air systems, and provided with a hot air hood.

FIG. 2 shows a Yankee cylinder 10, mainly similar to that of FIG. 1, with its hoods 14, 16, 18 and air heating devices 20, 22, 24. Air is blown against the web in the same way as in the case of FIG. 1, and the air is returned from between the hoods and the cylinder in the same way. However, in the case shown in FIG. 2 the compensating air is arranged to pass first from the compensating air duct 26 only to the dry end hood section 18 of the Yankee hood. The air leaving this hood section 18 is directed by the fan 28 along the duct 26' via the heater 20 to the hot air hood 14. The air leaving the hot air hood is directed in the same way as in the case in FIG. 1 to the wet end hood section 16 of the Yankee hood. In the case of FIG. 2 the air supplied to the system will thus circulate sequentially through all hoods, before it is finally discharged from the wet end hood section 16 into the exhaust duct 32.

In the FIGS. 1 and 2 the hot air hood is arranged in front of the wet end hood section, so that the air to this section is supplied from the hot air hood. This structural solution can be best made in new machines. To existing Yankee cylinders it is most advantageous to connect a hot air hood provided with a totally separate air system.

Figure 3:
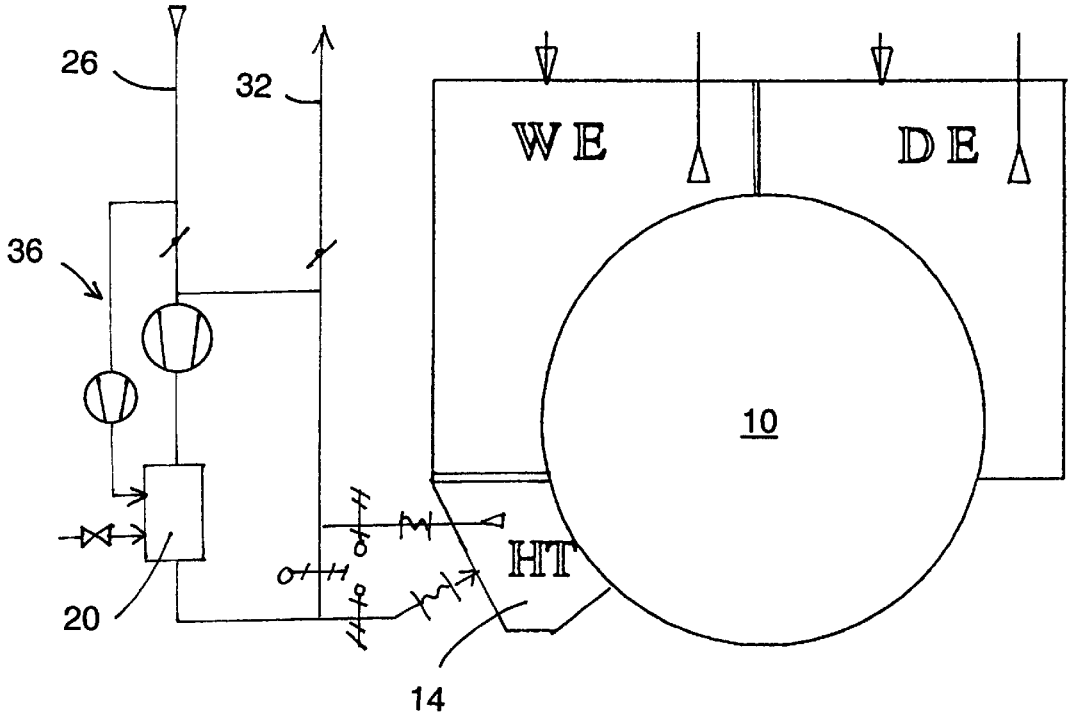
FIG. 3 shows a part of the Yankee cylinder according to FIG. 1 provided with a hot air hood, however, without showing the air arrangements of the Yankee hood.

FIG. 3 shows a Yankee cylinder 10 to which there is connected a hot air hood 14 having a separate air circulating system 36 of its own. Air is supplied by the compensating air channel 26 to the air heating device 20, where the air is heated to a temperature >550° C., after which the air is directed to the hot air hood. A part of the air leaving the hot air hood is directed to the air heating device so that it is recirculated. A part of the air is directly discharged into the exhaust air duct 32.

Figure 4:
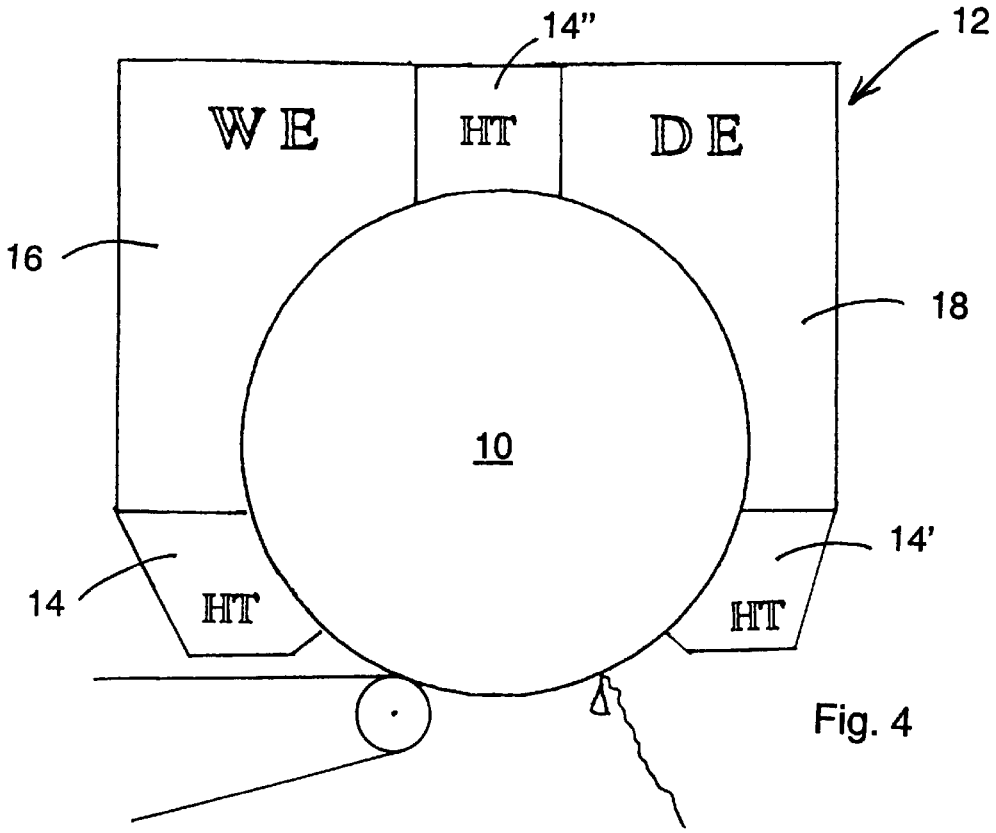
FIG. 4 shows schematically a Yankee hood, where a number of hot air hoods according to the invention are added.
Figure 5:
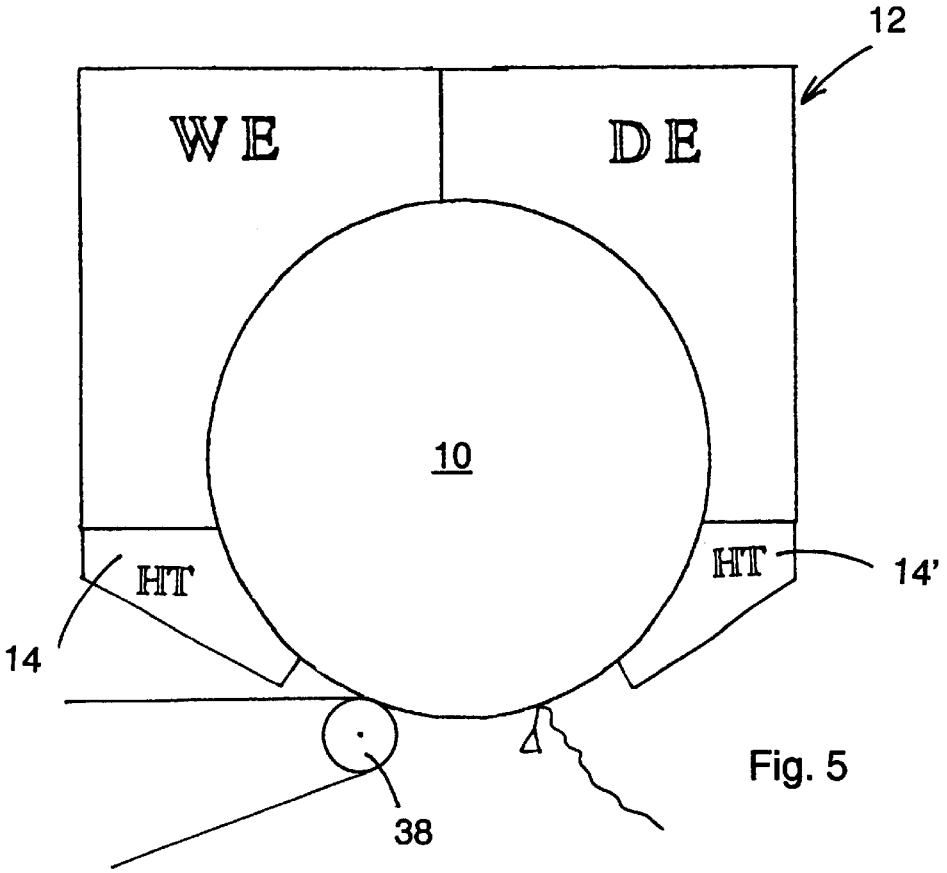
FIG. 5 shows schematically the Yankee hood according to FIG. 4, where two hot air hoods according to the invention are added.

The FIGS. 1 to 3 show Yankee cylinders with one connected hot air hood. However, it is also possible to arrange several of these hoods over the cylinder, when desired. FIG. 4 shows a Yankee cylinder, where a hot air hood 14, 14' is arranged both before the Yankee hood 12 and after it. A further hot air hood 14" is arranged between the sections 16, 18 of the Yankee hood. FIG. 5 shows a Yankee cylinder where hot air hoods 14, 14' with a relatively large coverage are arranged on both sides of the Yankee hood at the lower part of the cylinder. The hot air hoods are tapering downwards in the direction of the periphery, whereby they occupy very little space in the neighbourhood of the Yankee cylinder at their lowest position. The hot air hoods 14, 14' can find room in a very little space between the press roll 38 and the cylinder 10.

Figure 6:
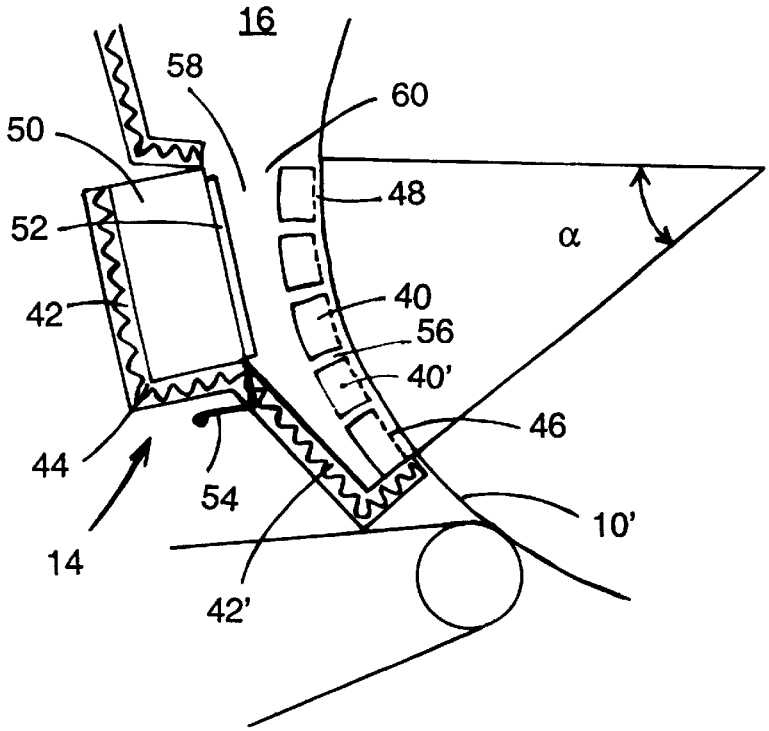
FIG. 6 shows schematically a hot air hood according to the invention in a vertical cross section in the machine direction.

FIG. 6 shows a vertical cross section of a hot air hood 14 which is arranged immediately in front of the wet end hood section 16 of the Yankee hood. The hot air hood covers an angle $\alpha$, typically a sector of about 40° of the periphery 10' of the cylinder. The hot air hood comprises a box-like structure where the side towards the periphery 10' of the cylinder is limited by blow-boxes 40, 40' and the side away from the cylinder is limited by walls 42, 42'. The walls are for instance made of a double plate structure, where a heat insulation 44 is arranged between the plates. In the downwards direction the walls approach the cylinder periphery 10', whereby the hot air hood becomes narrower, which is also shown in FIG. 7.

Figure 7:
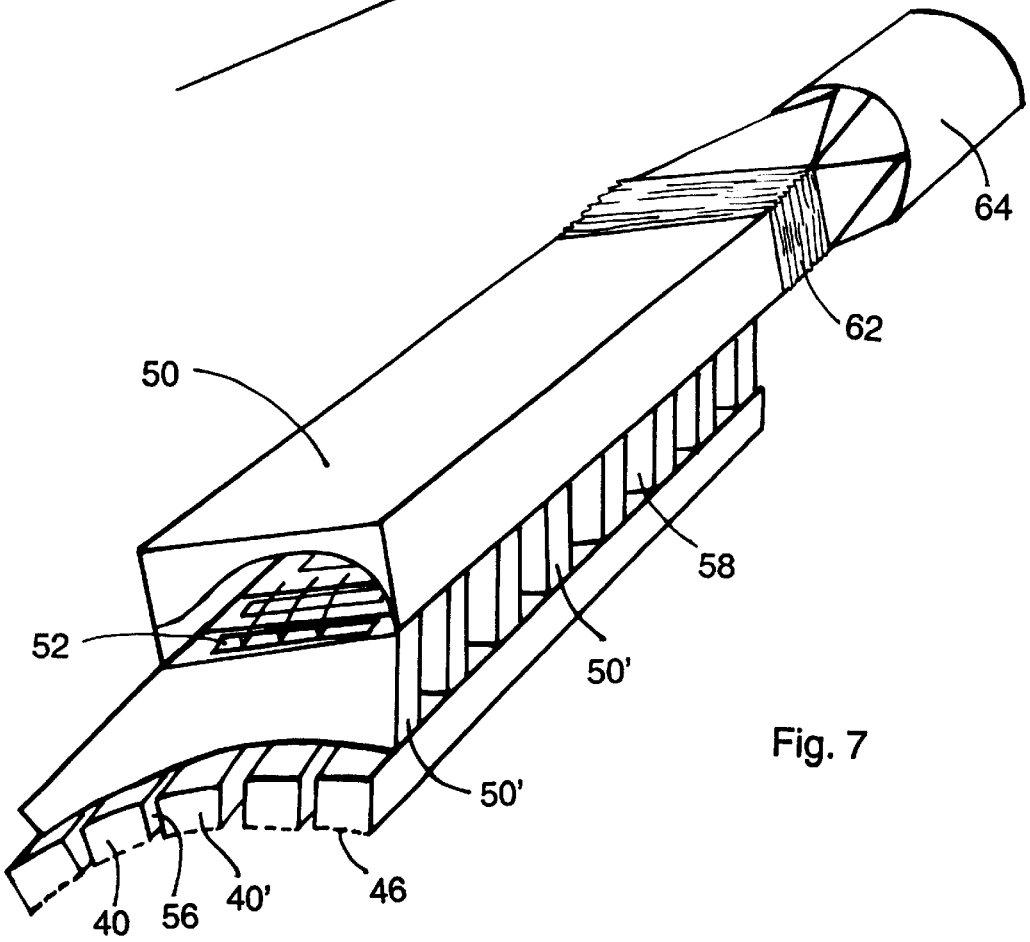
FIG. 7 shows schematically a hot air hood according to the invention seen obliquely from one side and partly open.

The blow-boxes 40, 40' shown in the FIGS. 6 and 7 are narrow boxes extending across the web and having walls 46 towards the cylinder, in which walls there are formed small blowing openings, from which air is blown into the space 48 defined by the cylinder periphery 10' and the boxes 40. The walls 46 of the boxes 40, 40' form an interface towards the cylinder which has the curvature of the cylinder periphery 10'. An air input channel 50 is arranged within the hot air hood, from which channel the air is directed via the control channels 50' to the boxes 40. The control channels are not shown in FIG. 6, which shows a cross section taken between the control channels. Dampers 52 are arranged between the air input channel 50 and the inputs of the control channels 50', and these dampers can control the air input to the boxes 40, for instance with the aid of a member 54. Between the adjacent boxes 40 and 40' there is formed a slot 56, through which the air can be discharged from the space 48 and through the chamber 58 and the opening 60 to the wet end hood section 16 of the Yankee hood. The FIG. 7 shows in addition a bellows-like structure 62, with which the hot air hood 14 is connected to the air input duct 64.

Figure 8:
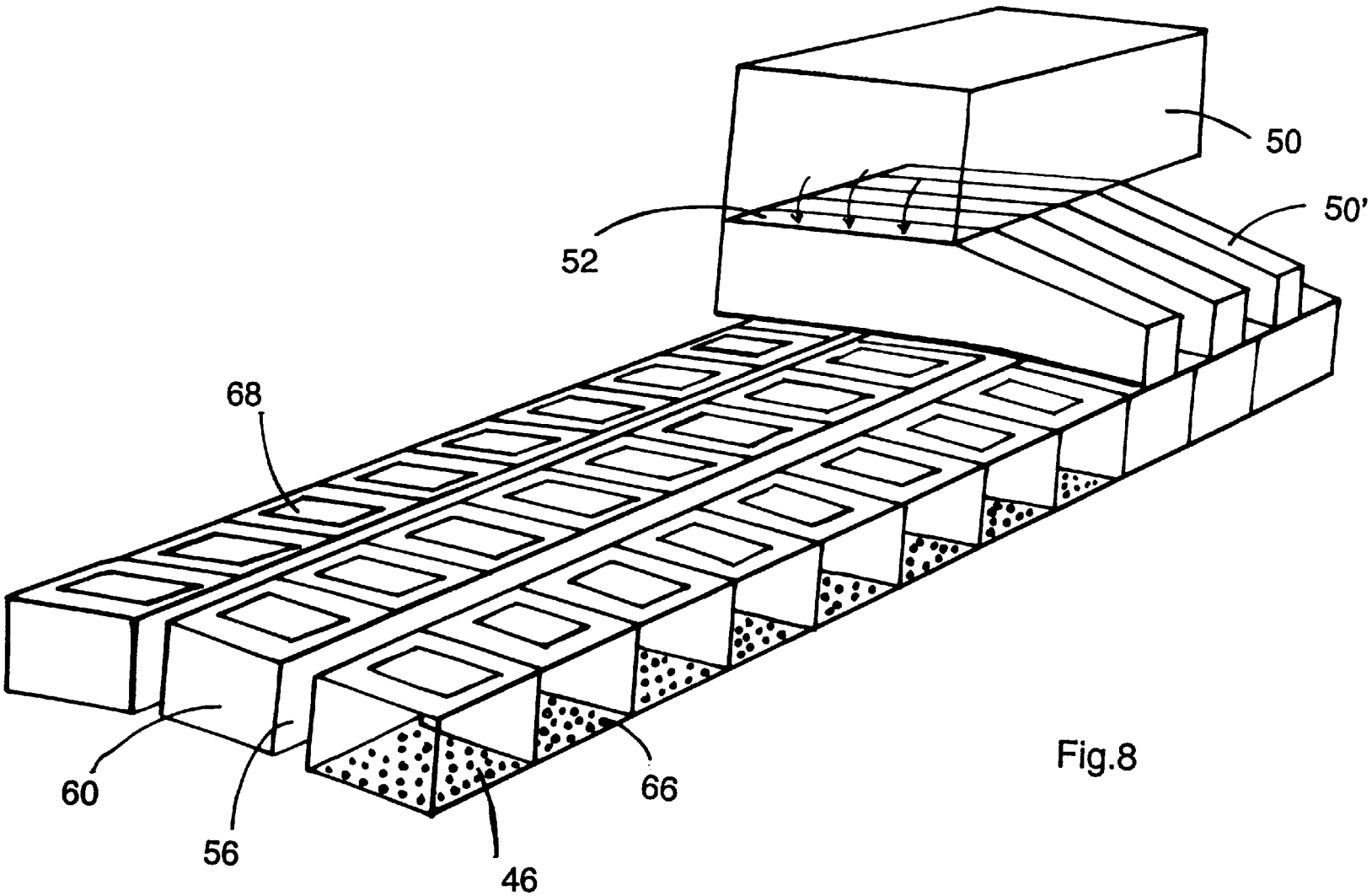
FIG. 8 shows schematically some of the means generating hot air jets which are arranged in a hot air hood according to the invention seen obliquely from one side.

The FIG. 8 shows schematically a partly stripped-down figure of the blow-boxes 40, in which openings 66 are formed in the wall 46 against the cylinder, from which openings air is blown against the web conveyed over the cylinder. Air is directed from the air input channel 50 (of which only a part is shown) extending across the web through the openings equipped with dampers 52 to the control channels 50' (of which only some are shown) extending in the direction of the web, and from them further to the blow-boxes 40, of which there are three in the case shown in the figure, through the openings 68 formed in the walls of the blow boxes, opposite to the web, consecutively in the web cross direction. Air is discharged from the region of the web through the slots 56 between the blow-boxes and into the space defined by the hood.

Figure 9:
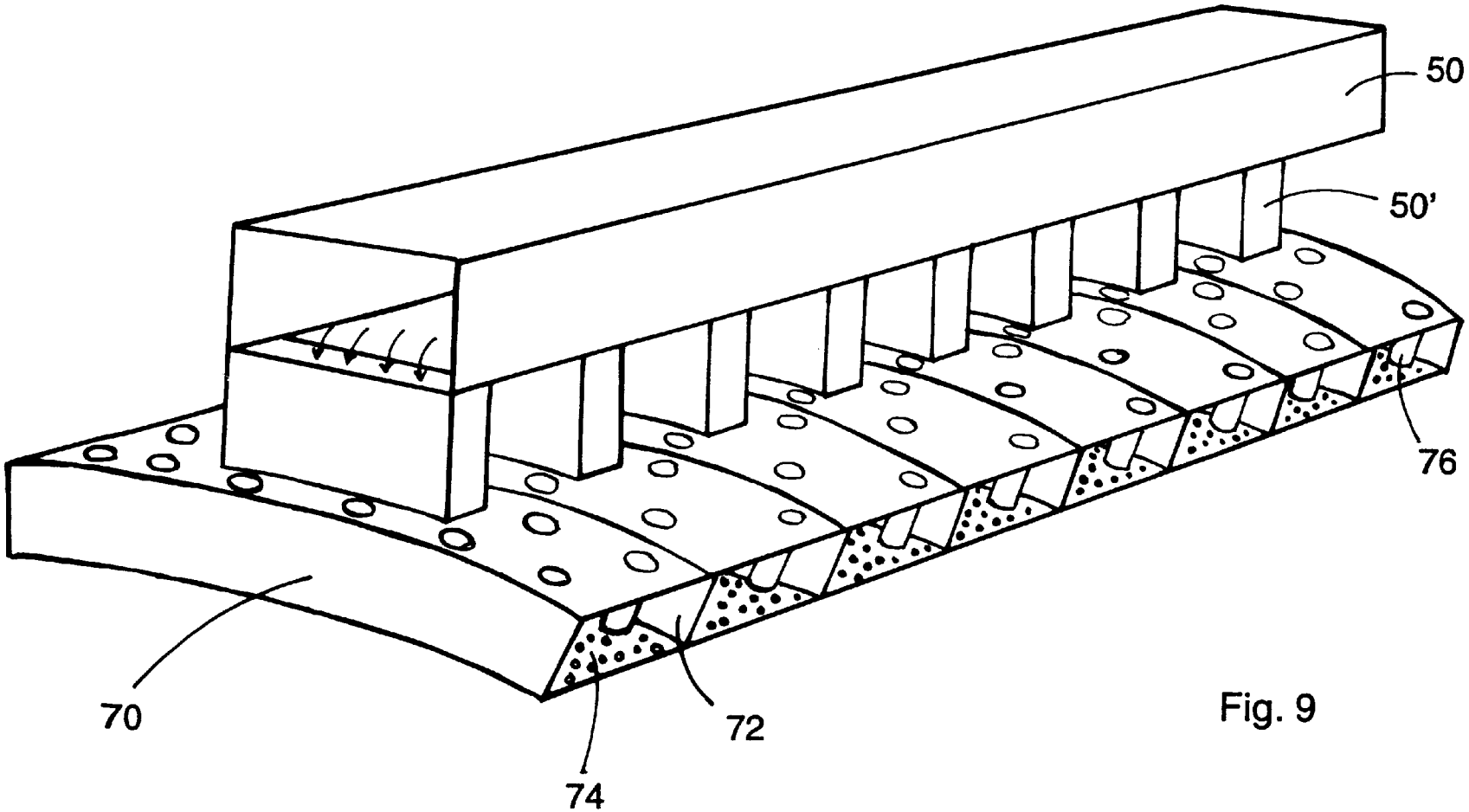
FIG. 9 shows according to FIG. 8 other means generating hot air jets which are arranged in a hot air hood according to the invention.

FIG. 9 shows a slightly different blow-box construction. The box is formed by a box 70 which is continuous in the direction of travel of the web, and which is divided into consecutive sections 74 in the web cross direction. A number of exhaust pipes 76 are formed in each section so that they pass through the box in the radial direction of the cylinder, and the discharge air is directed through these pipes to the space 58 (FIG. 7) defined by the hot air hood, to be further supplied to the Yankee hood. The input air is supplied in a similar way as in the solution of FIG. 8 via the input and control channels 50, 50' to the blow-boxes.

The invention is not intended to be limited to the applications presented as examples above, but on the contrary, it is intended to be widely applied within the inventive idea defined in the claims presented below.

What is claimed is:

1. Method for improving the drying capacity of a drying hood covering a Yankee cylinder, when drying a web with a Yankee cylinder while conveying the web over the cylinder by blowing hot air jets against the web at the region of a first hood, said hot air jets having a temperature mainly <550° C., characterized in that the drying capacity of the drying hood is increased by blowing hot air jets against the web conveyed over the cylinder at the region of a second hood, a so called hot air hood which is smaller than the first hood, said hot air jets having a temperature which is higher than the temperature of the hot air jets blown against the web at the first hood, or mainly >550° C.

2. A method according to claim 1, characterized in that the hot air hood is arranged in front of the first hood as seen in the travel direction of the web, whereby air jets having a temperature, which is higher than that of the air jets blown against the web at the first hood, or mainly>550° C., are first blown against the web at the region of the hot air hood, and then hot air jets having a temperature <550° C. are blown against the web at the region of the first hood.

3. A method according to claim 1, characterized in that the first or second hot air hood is arranged, in the travel direction of the web, after the first hood, whereby hot air jets having a temperature, which is higher than that of the air jets blown against the web at the first hood, or mainly >550° C., are blown against the web after the first hood.

4. A method according to claim 1, characterized in that the first hood is divided into a wet end hood section and a dry end hood section arranged consecutively in the travel direction of the web, and that the hot air hood is arranged between the first and second hood sections, whereby hot air jets are blown against the web, consecutively as seen in the travelling direction of the web, so that at the region of the wet end hood section hot air jets having a temperature <550° C. are blown against the web, at the region of the hot air hood air jets having a temperature, which is higher than the temperature of the hot air jets blown against the web at the first hood, or mainly >550° C. are blown against the web; and at the region of the dry end hood section air jets having a temperature <550° C. are blown against the web.

5. A method according to claim 4, characterized in that further a second hot air hood is arranged, as seen in the travel direction of the web, in front of the wet end hood section of the first hood, and/or after the dry end hood section of the first hood, whereby further hot air jets are blown at the region of the hot air hood against the web before the wet end hood section and/or after the dry end hood section, these further air jets having a temperature which is higher than the temperature of the hot air jets blown at the first hood, or mainly >550° C.

6. A method according to claim 1, characterized in that hot air jets are blown against the web at the region of the hot air hood, these hot air jets having a temperature of 550° C. to 700° C.

7. A method according to claim 1, characterized in that the hot air jets blown against the web at the region of the hot air hood are divided in the cross direction of the web into consecutive hot air jet groups, and that the temperature of each hot air jet group is individually controlled in order to control the drying power profile.

8. A method according to claim 1, characterized in that the hot air jets blown against the web at the region of the hot air hood are divided in the cross direction of the web into consecutive hot air jet groups, and that the velocity of the hot air jets of each hot air jet group is individually controlled in order to control the drying power profile.

9. A method according to claim 1, characterized in that at least a part of the air discharged from the hot air hood is directed to the first hood, advantageously to the wet end section of the first hood.

10. A method according to claim 1, characterized in that at least a part of the air discharged from the dry end of the first hood is directed to the hot air hood.

11. A method according to claim claim 1, characterized in that the hot air hood is connected to an own air system, in order to heat the discharged air and to return it as drying air to the hood.

12. Apparatus for improving the drying capacity of the drying hood covering a Yankee cylinder, which has a first hood, for blowing hot air jets at a temperature below 550° C. against a web conveyed over the Yankee cylinder, characterized in that the apparatus further comprises a hot air hood, which is smaller than the first hood and which is arranged to blow hot air jets against the web conveyed over the Yankee cylinder, the temperature of said hot air jets being higher than the temperature of the hot air jets blown against the web at the first hood, or being mainly over 550° C.

13. An apparatus according to claim 12, characterized in that the hot air hood is arranged, as seen in the travel direction of the web, before and/or after the first hood.

14. An apparatus according to claim 12, characterized in that the first hood is divided into a wet end hood section and a dry end hood section, and that the hot air hood is arranged, as seen in the travel direction of the web, before, after, and/or between the hood sections.

15. An apparatus according to claim 12, characterized in that the exhaust air duct of the hot air hood is connected to the enclosure of the wet end section of the first hood in order to direct the discharge air from the hot air hood to the air circulation of the wet end of the first hood.

16. An apparatus according to claim 12, characterized in that the air exhaust duct of the dry end section of the first hood is connected to the hot air hood in order to direct the discharge air from the dry end section of this first hood to the hot air hood.

17. An apparatus according to claim 12, characterized in that the hot air hood covers about 20° to 40°, even 60°, of the periphery of the Yankee cylinder.

18. An apparatus according to claim 12, characterized in that the first hood is arranged to cover the main part of the upper half of the Yankee cylinder, and that the hot air hood is arranged to cover a part of the lower half of the Yankee cylinder.

19. An apparatus according to claim 12, characterized in that in a vertical cross section in the machine direction the hot air hood is tapering towards the Yankee cylinder.

20. An apparatus according to claim 12, characterized in that the hot air hood is divided in the web cross direction into sections, in which there are arranged means to control the velocity of the hot air flowing through the means, in order to control the drying effect of the hot air jets in the web cross direction.

21. An apparatus according to claim 12, characterized in that the hot air hood is provided with blow-boxes extending across the web and arranged consecutively in the travel direction of the web, whereby openings or corresponding are formed in the wall of the blow-boxes, which wall is directed towards the Yankee cylinder, in order to blow hot air against the web conveyed over the Yankee cylinder, and exhaust air ducts are arranged between the blow-boxes in the direction across the web in order to return the air from the space between the hot air hood and the Yankee cylinder into the hot air hood.

22. An apparatus according to claim 12, characterized in that the interface of the hot air hood against the Yankee cylinder is formed mainly of a plate having the same curvature as the Yankee cylinder, whereby small openings or corresponding are formed in the plate in order to blow hot air from the hot air hood against the web, and large openings communicating with the exhaust pipes are formed in the plate in order to return air from the space between the hot air hood and the Yankee cylinder into the hot air hood.

23. A method of drying a web utilizing a first drying hood covering part of a Yankee cylinder, and a second hot air hood which is smaller than the first drying hood, covering another part of the Yankee cylinder, said method comprising:

(a) conveying the web over the Yankee cylinder underneath the first and second hoods;

(b) at the location of the first hood blowing jets of hot air having a temperature at least 20° C. over ambient and less than 550° C. against the web as the web is conveyed over the Yankee cylinder; and (c) at the location of the second, hot air, hood blowing jets of hot air at a temperature at least 10° C. higher than the temperature in (b), and over about 550° C. onto the web as it passes over the Yankee cylinder, so as to increase the drying capacity at the Yankee cylinder.

24. A web drying apparatus comprising:

a Yankee cylinder;

a first drying hood for blowing jets of hot air at a temperature below 550° C. against a web traveling over said Yankee cylinder; and a second hot air hood, smaller than said first hood, for blowing jets of hot air against a web while it is conveyed over said Yankee cylinder, the jets blown against the web within said second hood being at a temperature higher than the temperature of the air blown within said first hood, and over about 550° C.

* * * * *